United States Patent [19]

Baker et al.

[11] 4,406,210

[45] Sep. 27, 1983

[54] JET-PROPELLED MISSILE WITH SINGLE PROPELLANT-EXPLOSIVE

[75] Inventors: Alan C. Baker, Huntington Beach, Calif.; John E. Roach, Jr., Alexandria, Va.

[73] Assignee: Brunswick Corporation, Skokie, Ill.

[21] Appl. No.: 235,014

[22] Filed: Feb. 17, 1981

[51] Int. Cl.[3] ..... F41F 3/04; F42B 13/30

[52] U.S. Cl. ..... 89/1.808; 42/1 F; 102/379; 149/92; 149/95

[58] Field of Search ..... 42/1 F; 89/1.808; 102/378-381, 374, 483, 488; 149/92, 95

[56] References Cited

U.S. PATENT DOCUMENTS

| | | | |
|---|---|---|---|
| 792,716 | 6/1905 | Maxim | 149/106 |
| 932,214 | 8/1909 | Wieser | 42/1 F X |
| 3,066,139 | 11/1962 | Zhivadinovich et al. | 149/36 X |
| 3,122,570 | 2/1964 | Stansbury et al. | 149/122 X |
| 3,245,350 | 4/1966 | Kelly | 89/1.808 |
| 3,379,588 | 4/1968 | Corsi et al. | 149/95 X |
| 3,390,183 | 6/1968 | Frankel et al. | 149/88 X |
| 3,396,170 | 8/1968 | Fetter | 149/122 X |
| 3,423,463 | 1/1969 | Baum | 149/122 X |
| 3,432,554 | 3/1969 | Peters | 149/122 X |
| 3,449,358 | 6/1969 | Dinwoodie et al. | 149/122 X |
| 3,490,373 | 1/1970 | Fox | 102/488 |
| 3,554,078 | 1/1971 | Horvath | 89/1.808 |
| 3,572,249 | 3/1971 | Davis | 102/374 |
| 3,756,874 | 9/1973 | Chang et al. | 149/19.4 |
| 3,996,080 | 12/1976 | Stack | 149/95 X |
| 4,078,495 | 3/1978 | Ledden | 149/92 X |
| 4,196,026 | 4/1980 | Walker et al. | 149/92 X |
| 4,298,411 | 11/1981 | Godsey | 149/95 X |

*Primary Examiner*—David H. Brown

*Attorney, Agent, or Firm*—William G. Lawler, Jr.; John R. Hoffman

[57] ABSTRACT

A spin-stabilized spherical jet-propelled missile is disclosed for use in combination with a launching apparatus which includes rotary means for rotating the missile and release means for releasing the missile after a period of initial spinup. The missile includes a housing, an exhaust nozzle on the housing, and a pressure chamber within the housing in communication with the exhaust nozzle. A single explosive compound is disposed as a singular mass within the housing and has a burn surface exposed in the pressure chamber. An impact fuze is disposed on the housing remote from the burn surface of the explosive compound for detonating the explosive compound on impact of the missile. Initial burning of a portion of the explosive compound at said burn surface is effective to drive gases through the exhaust nozzle and to the rotary means of the launching apparatus during spinup, and during flight of the missile, and the fuze is effective to detonate the remainder of the explosive compound on subsequent impact of the missile. The single explosive compound comprises a double based propellant including a high energy plasticizer, such as a nitrated plasticizer, in combination with a high explosive, such as an HMX crystalline explosive, to give a relatively slow burn rate and a relatively high detonating rate.

16 Claims, 4 Drawing Figures

JET-PROPELLED MISSILE WITH SINGLE PROPELLANT-EXPLOSIVE

BACKGROUND OF THE INVENTION

This invention relates to a jet-propelled projectile, and particularly to a spherical spin-stablized missile.

It has become increasingly important to eliminate the undesirable features associated with a ballistic trajectory ordinarily followed by rockets and other jet-propelled projectiles, by forming the projectiles as spherical spin-stabilized missiles. The spherical missile spins about an axis upwardly inclined relative to the intended straight line path of flight and aligned with the thrust axis of the propulsion jet of the missile. The missile is released following ignition or activation of the jet propellant within the missile. The propulsion is effected by the reaction of the exhaust jet of, for example, a rocket motor housed within the spherical missile shell.

Such conventional missile systems generally include a separate rocket motor having its own propellant material and a separate payload of explosive material, both of which form a system within the missile shell. The rocket motor propellant grain is separated from the payload explosive within the missile shell, the rocket propellant being effective to drive gases through an exhaust nozzle of the missile during initial spinup and flight of the missile, and the payload explosive being effective to detonate the missile upon impact thereof responsive to an impact fuze means on the missile shell.

The present invention is directed to providing a new and improved jet-propelled missile of the character described wherein the separate rocket propellant grain and the separate payload explosive are combined in a single explosive compound which involves a normal rocket motor ignition procedure followed by propellant burn of the single explosive compound to the target, and detonation of the remaining explosive compound by the fuze on target contact.

The invention, therefore, significantly reduces the missile cost and the overall weight of the missile by eliminating all of the parts required for the rocket motor. Assembly of the missile is greatly simplified with a single explosive loading operation versus the conventional loading of separate propellant and explosive materials. All of this is accomplished while still delivering the same amount of explosive material to the target as is possible with conventional systems.

SUMMARY OF THE INVENTION

An object, therefore, of the present invention is to provide a new and improved jet-propelled missile of the character described.

In the exemplary embodiment of the invention, a spin-stabilized spherical jet-propelled missile is adapted for use with a launching apparatus for facilitating launching of the missile. The apparatus includes rotary means and means for supporting the rotary means for rotation about a spin axis coaxial with the exhaust nozzle of the missile, and means for releasing the missile for spin-stabilized flight after a period of initial spinup. The missile includes a housing, an exhaust nozzle assembly, and a pressure chamber within the housing in communication with the exhaust nozzle. A single explosive compound is disposed within the missile housing and has a burn surface exposed in the pressure chamber. Impact fuze means is disposed on the housing remote from the burn surface of the explosive compound for detonating the explosive compound on impact of the missile.

With this novel missile construction, initial burning of a portion of the single explosive compound at said burn surface is effective to drive gases through the exhaust nozzle of the missile to the rotary means of the launching apparatus during initial spinup and subsequent flight of the missile. The fuze means is effective to detonate the remainder of the single explosive compound on impact of the missile on target contact.

The single explosive compound comprises a singular mass thereof within the missile housing and is in the form of a double-based propellant including a high energy plasticizer, such as a nitrated plasticizer, in combination with a high explosive, such as an HMX crystalline explosive, to give a relatively slow burn rate and a relatively high detonation rate. Such a composition of the double-based propellant would have a burn rate on the order of approximately 4,000 feet/second and a detonation rate on the order of approximately 22,000 feet/second.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
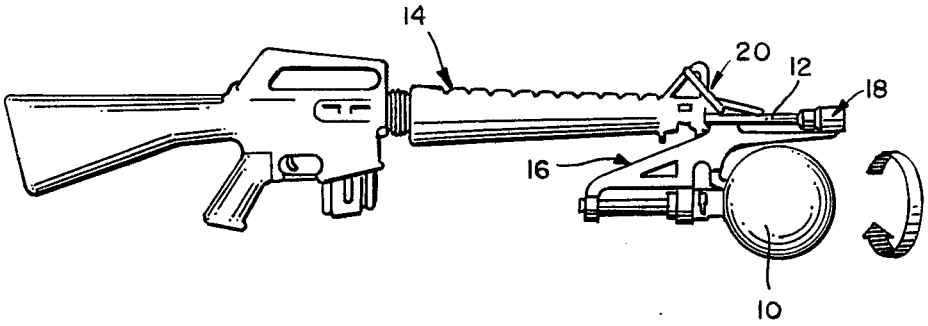
FIG. 1 is an elevational view of a spherical spin-stabilized missile mounted on the barrel of a rifle.

Referring to the drawings in greater detail, and first to FIG. 1, a spherical spin-stabilized jet-propelled missile 10 is shown mounted to the front of a barrel 12 of an assault weapon such as a rifle, generally designated 14. The rifle shown is a standard M-16A1 military rifle.

Figure 2:
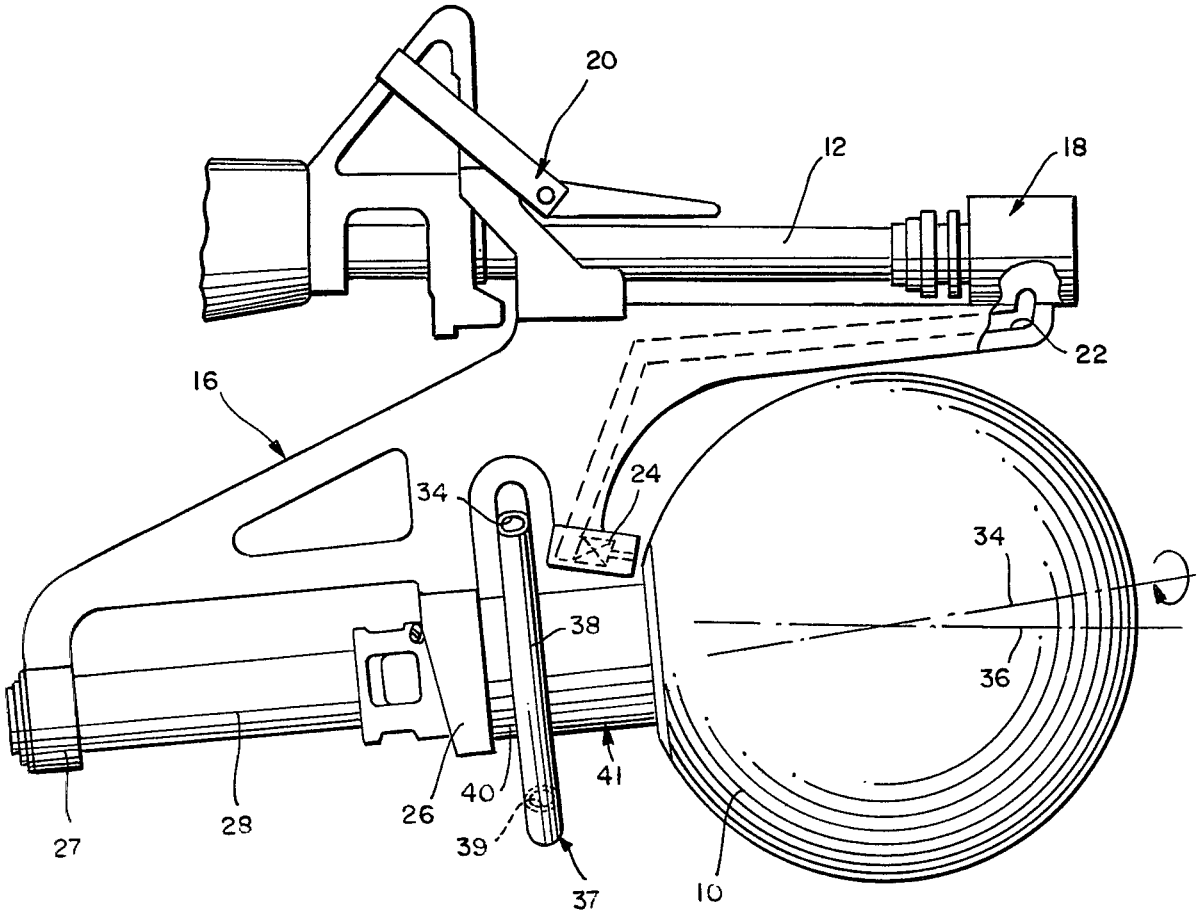
FIG. 2 is a fragmented side elevational view, on an enlarged scale, of the spherical missile mounted on the front end of the rifle as shown in FIG. 1.

As shown in FIG. 1 and in the enlarged view of FIG. 2, a missile support means, generally designated 16, includes a front upper bracket portion, generally designated 18, and a rear upper latch portion, generally designated 20. Bracket portion 13 is positioned on the barrel 12 whereby part of the gas emanating from the barrel is channeled through a passageway 22 to a pneumatically actuated pin assembly 24 which is effective to strike a primer on missile 10 to ignite the rocket propellant therein, as is known in the art. Latch 20 simply is provided to lock support means 16 onto the rifle barrel.

Support means 16 also includes turbine support portions 26 and 27, and a launcher shaft 28. Launcher shaft 28 is disposed on an axis 34 upwardly inclined relative to an intended straight line path of flight 36 generally parallel to the axis of rifle barrel 12. As is known in the art, axis 34 is the spin axis of missile 10: i.e., the motor thrust of the missile rocket motor. Axis 36 which defines the line of flight of the missile is the forward velocity component thereof.

Rotary means, generally designated 37, includes a turbine 38 having turbine nozzles 39. The turbine is fixed to a hub 40 which forms an extension of shaft 28 and which extends rearwardly thereof. In assembly, shaft 28 protrudes rotatably within turbine support means 26 and 27. Appropriate bearings or bushings (not shown) are disposed in turbine support portions 26 and 27.

Release means, generally designated 41, is provided for temporarily restraining and automatically releasing the spin-stabilized jet-propelled spherical missile during initial spinup. For instance, release means 41 may comprise a fusible link for temporarily restraining and automatically releasing the missile during spinup. A new and improved fusible joint release means is shown in co-pending U.S. patent application Ser. No. 206,370, filed on Nov. 13, 1980 to Alan Clark Baker and Joe Thomas Zinn, Jr., and assigned to the assignee of the present application. That contemporaneously filed application is incorporated herein by reference simply to show the details of the turbine means 38, the release means 41, and other similar related mechanisms.

Figure 3:
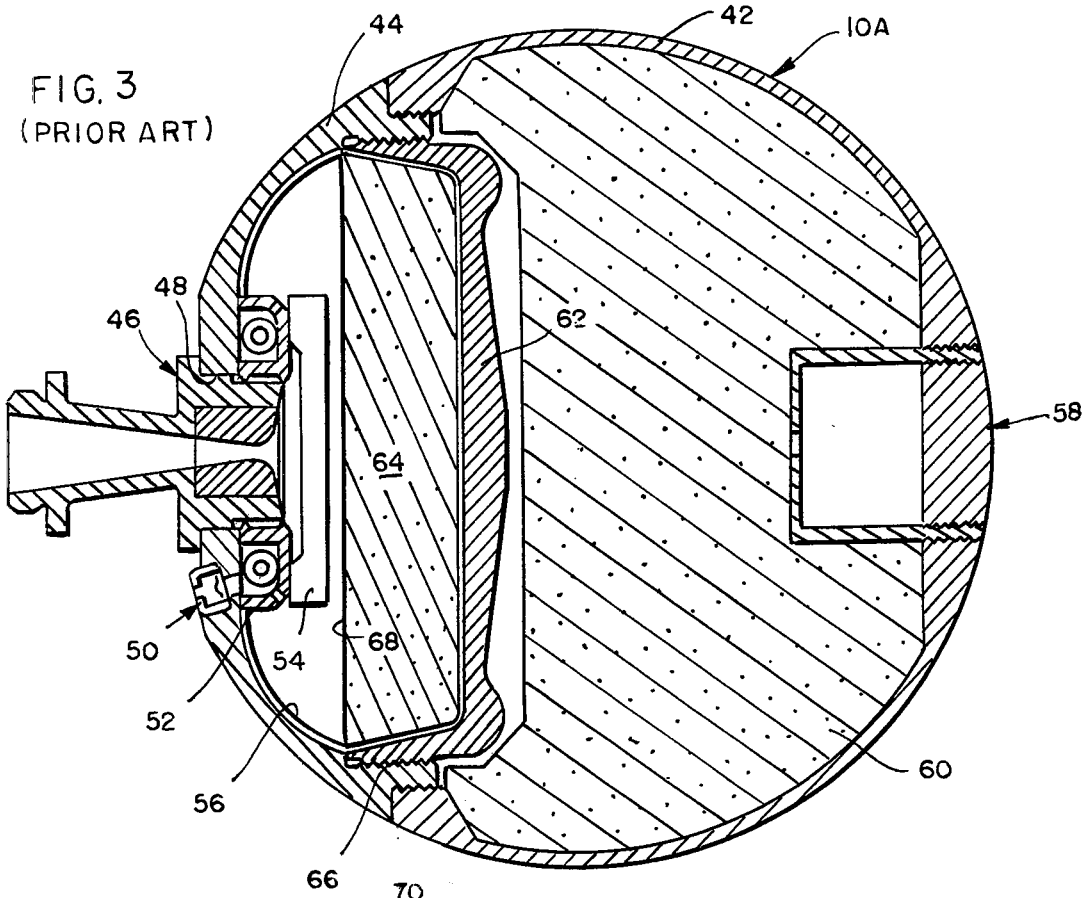
FIG. 3 (PRIOR ART)
FIG. 3 is a sectional view, on a further enlarged scale, of a spin-stabilized spherical jet-propelled missile of the prior art, including a separate rocket motor.

Referring to FIG. 3, a type of spin-stabilized spherical jet-propelled missile, generally designated 10A, is shown in accordance with the prior art. This missile includes a housing or shell 42 threaded to a motor case 44 and a nozzle assembly, generally designated 46, disposed within an aperture 48 in motor case 44. The missile includes a primer, generally designated 50 and an ignition chamber 52. An anti-vortex plate 54 is provided to prevent vortexing of propellant material due to the tendency of exhaust gases to vortex at the center of a pressure chamber 56. An impact fuze, generally designated 58, is provided on a forward side of missile 10A, opposite nozzle assembly 46, to detonate a mass 60 of payload explosive material on impact of the missile at target contact. All of the aforesaid components of prior art missile 10A are known.

Missile 10A of FIG. 3 also includes an interior casing 62 which contains a propellant grain 64. Casing 62 is threaded at 66 to the interior of motor case 44 to define pressure chamber 56. Propellant grain 64 has a burn surface 68 which is ignited by means of primer 50 and materials contained in chamber 52, as is known in the art. Primer 50 is actuated by known means from gas eminating from the end of rifle barrel 12. Exhaust gases from the burning propellant grain 64 pass through exhaust nozzle assembly 46 to turbine means 38 (FIGS. 1 and 2) to attain desired rotational speed of the missile during initial spinup as the missile is temporarily restrained. Release means 41 automatically releases the missile after reaching the desired rotational speed whereby the missile rotates about axis 34 (FIG. 2) and travels its intended straight line path of flight 36 toward a target.

Figure 4:
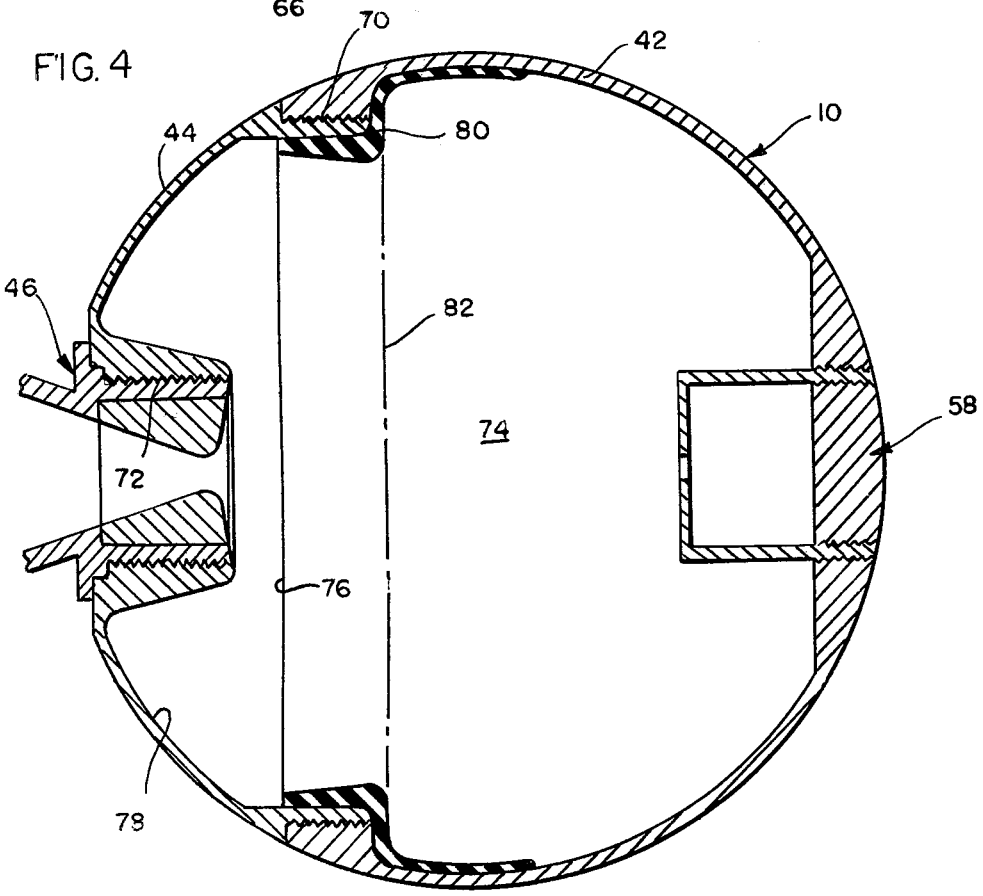
FIG. 4 is a sectional view similar to that of FIG. 3, but illustrating the spin-stabilized spherical jet-propelled missile of the present invention, having a single propellant-explosive compound.

The spin-stabilized spherical jet-propelled missile of the present invention is shown in FIG. 4 and is indicated generally by the numeral 10, corresponding to FIGS. 1 and 2. It should be pointed out that the missile 10 shown in FIG. 4 includes basic components corresponding to the missile housing or shell 42, casing 44, and nozzle assembly 46 as described in relation to missile 10A of FIG. 3. Of course, missile 10 shown in FIG. 4 also would include primer 50, ignition chamber ring 52, and anti-vortex plate 54 as shown in FIG. 4, but these components have been deleted in order to emphasize the single explosive compound of the present invention, as described hereinafter. Suffice it to say, casing 44 is threaded to shell 42, as at 70, and nozzle assembly 46 is threaded to casing, 44 as at 72. Impact fuze 58 also is shown.

In accordance with the present invention, a single propellant-explosive compound 74 is loaded within shell 42 by a single loading operation so that the compound has a burn surface 76 exposed within a pressure chamber 78 within casing 44. A stress relief liner/inhibitor 80 is disposed about the interior of the missile so as to span the juncture between shell 42 and casing 44.

The singular mass 74 of propellant-explosive compound of the present invention comprises a double-based propellant including a high energy plasticizer in combination with a high explosive to give a relatively slow burn rate, at burn surface 76, and a relatively high detonation rate responsive to impact of fuze means 58. In the preferred embodiment of the invention, the double-based propellant which comprises compound 74 has a high energy plasticizer in the form of a nitrated plasticizer, in combination with a high explosive in the form of an HMX crystalline explosive.

With the single propellant-explosive compound 74 of the present invention and as described above, initial burning of a portion of the single explosive compound at burn surface 76 is effective to drive gases through exhaust nozzle assembly 46 to rotary means, i.e, turbine 26, of the launching apparatus during initial spinup of the missile and during flight of the missile toward a target. Fuze means 58 is effective to detonate the remainder of the single propellant-explosive compound on subsequent impact of the missile on target contact. Dot-dash line 82 indicates an approximate surface of the single propellant-explosive compound after "burn out" and detonation of the missile on target contact. It can be seen that considerable explosive material remains for detonation.

A propellant-explosive compound composed as above described would have a burn rate at burn surface 76 on the order of approximately 4,000 feet/second, and a detonation by fuze means 58 on the order of approximately 22,000 feet/second.

Thus, it can be seen that the present invention provides a new and improved spin-stabilized spherical jet-propelled missile which utilizes a novel single propellant-explosive compound to eliminate the separate rocket motor and propellant grain of conventional missile systems of the character described. The accompanying conventional parts and separate loading operations consequently are eliminated whereby the present invention significantly reduces the end-item costs of such missiles.

It will be understood that the invention may be embodied in other specific forms without departing from the spirit or central characteristics thereof. The present examples and embodiments, therefor, are to be considered in all respects as illustrative and not restrictive, and the invention is not to be limited to details given herein.

What is claimed is:

1. In combination, a spin-stabilized spherical jet-propelled missile, having an exhaust nozzle, and an apparatus for facilitating launching of said missile, comprising:

said apparatus including rotary means and means for supporting said rotary means for rotation about a spin axis coaxial with the exhaust nozzle of said missile, and means for releasing said missile for spin-stabilized flight after a period of initial spinup; and said missile including a housing, a pressure chamber within said housing in communication with said exhaust nozzle, a singular homogeneous mass comprised of a single propellant-explosive compound within said housing and having a burn surface exposed in said pressure chamber, and impact fuze means on said housing remote from said burn surface for detonating said single propellant-explosive compound on impact of said missile;

whereby initial burning of a portion of said single propellant-explosive compound at said burn surface is effective to drive gases through said exhaust nozzle to said rotary means during spinup and during flight of the missile, and said fuze means is effective to detonate the remainder of said single propellant-explosive compound on subsequent impact to said missile on target contact.

2. The combination of claim 1, wherein said single propellant-explosive compound has a burn rate at said burn surface on the order of approximately 4,000 feet/-second and a detonation rate on the order of approximately 22,000 feet/second.

3. The combination of claim 1, wherein said single propellant-explosive compound comprises a double-based propellant including a high energy plasticizer in combination with a high explosive to give a relatively slow burn rate and a relatively high detonation rate.

4. The combination of claim 3, wherein said high energy plasticizer comprises a nitrated plasticizer.

5. The combination of claim 4, wherein said high explosive comprises an HMX crystalline explosive.

6. A spin-stabilized spherical jet-propelled missile, having an exhaust nozzle, for use with a launching apparatus which includes rotary means for rotating said missile and release means for releasing said missile after a period of initial spinup, said missile comprising:

a housing, a pressure chamber within said housing in communication with said exhaust nozzle, a singular homogeneous mass comprised of a single propellant-explosive compound within said housing and having a burn surface exposed in said pressure chamber, and impact fuze means on said housing remote from said burn surface for detonating said single propellant-explosive compound on impact of said missile;

whereby initial burning of a portion of said single propellant-explosive compound at said burn surface is effective to drive gases through said exhaust nozzle to said rotary means during spinup and during flight of the missile, and said fuze means is effective to detonate the remainder of said single propellant-explosive compound on subsequent impact of said missile on target contact.

7. The missile of claim 6, wherein said single propellant-explosive compound has a burn rate at said burn surface on the order of approximately 4,000 feet/second and a detonation rate on the order of approximately 22,000 feet/second.

8. The missile of claim 6, wherein said single propellant-explosive compound comprises a double-based propellant including a high energy plasticizer in combination with a high explosive to give a relatively slow burn rate and a relatively high detonation rate.

9. The missile of claim 8, wherein said high energy plasticizer comprises a nitrated plasticizer.

10. The missile of claim 9, wherein said high explosive comprises an HMX crystalline explosive.

11. A jet-propelled missile, comprising: a housing, an exhaust nozzle on said housing, a pressure chamber within said housing in communication with said exhaust nozzle, a singular homogeneous mass comprised of a single propellant-explosive compound within said housing and having a burn surface exposed in said pressure chamber, and impact fuze means on said housing remote from said burn surface for detonating said single propellant-explosive compound on impact of said missile.

12. The missile of claim 11, wherein said single propellant-explosive compound has a burn rate at said burn surface on the order of approximately 4,000 feet/second and a detonation rate on the order of approximately 22,000 feet/second.

13. The missile of claim 11, wherein said single propellant-explosive compound comprises a double-based propellant including a high energy plasticizer in combination with a high explosive to give a relatively slow burn rate and a relatively high detonation rate.

14. The missile of claim 13, wherein said explosive compound comprises a singular mass thereof contained within said housing.

15. The missile of claim 13, wherein said high energy plasticizer comprises a nitrated plasticizer.

16. The missile of claim 15, wherein said high explosive comprises an HMX crystalline explosive.

* * * * *

Disclaimer 4,406,210.—*Alan C. Baker*, Huntington Beach, Calif., and *John E. Roach, Jr.*, Alexandria, Va. JET-PROPELLED MISSILE WITH SINGLE PROPELLANT-EXPLOSIVE. Patent dated Sept. 27, 1984. Disclaimer filed Mar. 28, 1985, by the assignee, *Brunswick Corp.*

Hereby enters this disclaimer to claims 11–16 of said patent.

[*Official Gazette June 4, 1985.*]